United States Patent [19]

Woehrle

[11] 4,009,085

[45] Feb. 22, 1977

[54] LUBRICATING COATING FOR METAL SHEET

[75] Inventor: Richard E. Woehrle, Berkley, Mich.

[73] Assignee: M & T Chemicals Inc., Greenwich, Conn.

[22] Filed: Dec. 18, 1975

[21] Appl. No.: 642,065

Related U.S. Application Data

[60] Continuation of Ser. No. 545,986, Jan. 31, 1975, abandoned, which is a division of Ser. No. 320,642, Jan. 2, 1973, Pat. No. 3,922,183, which is a continuation-in-part of Ser. No. 158,511, June 30, 1971, abandoned.

[52] U.S. Cl. ..... 204/27; 204/28; 204/56 R

[51] Int. Cl.[2] ..... C25D 9/08

[58] Field of Search ..... 204/51, 56 R, 28, 27

[56] References Cited

UNITED STATES PATENTS

| | | | |
|---|---|---|---|
| 2,956,935 | 10/1960 | Passel | 204/51 |
| 3,489,662 | 1/1970 | Merker et al. | 204/51 |
| 3,703,449 | 11/1972 | Farr et al. | 204/56 R |

*Primary Examiner*—F.C. Edmundson
*Attorney, Agent, or Firm*—Kenneth G. Wheeless; Robert P. Auber; Robert Spector

[57] ABSTRACT

This invention relates to novel lubricating compositions and to a process for treating metal sheet or strip stock to impart lubricity and abrasion resistance thereto which comprises electrodepositing a lubricating film containing both trivalent chromium oxide and water soluble surfactant from an aqueous bath composition containing hexavalent chromium and at least one water soluble surfactant which comprises passing current from an anode to a cathode through said aqueous bath composition for a time period sufficient to deposit a lubricant-containing trivalent chromium oxide film upon said cathode.

7 Claims, No Drawings

LUBRICATING COATING FOR METAL SHEET

This is a continuation of application Ser. No. 545,986, filed Jan. 31, 1975, now abandoned which in turn is a divisional of Ser. No. 320,642 filed Jan. 2, 1973, now U.S. Pat. No. 3,922,183, which in turn was a continuation-in-part of the parent Ser. No. 158,511 filed June 30, 1971, now abandoned.

This invention relates to abrasion resistant surfaces. More specifically this invention relates to the cathodic codeposition or occlusion of a water soluble surfactant in protective chromium oxide films. The presence of these surfactants greatly enhances the lubricity and sliding mobility of the treated metal sheet or strip stock.

It is known that chromate coatings on the surfaces of basis metals such as iron and steel may be used to increase the corrosion resistance of such basis metals. Various methods have been employed in the prior art to produce lubricant containing coatings. However, none of the methods of the prior art simultaneously impart both lubricity and corrosion resistance.

The coating compositions and processes employed in the prior art have not been entirely satisfactory. The use of organic additives may provide uniform corrosion resistant deposits but the organic additives themselves may produce side products which do not impart lubricity, and in fact, promote scoring and abrasion.

It is an object of this invention to provide improved chromium oxide deposits having abrasion resistance and high corrosion resistance. It is an object of this invention to provide improved lubricant containing chromic oxide deposits having dual corrosion resistance and resistance to abrasion. Another object of this invention is to form codeposited lubricating chromium oxide films by the process of this invention. Sheet stock, cold-rolled carbon steel strip, can stock, strip, and mechanically formed articles of iron and steel can be treated rapidly and economically.

Another object of this invention is to develop an excellent base for organic coatings and to improve the adhesion of paint, lacquer and other organic finishes.

Another object of the invention is to provide novel compositions and processes for the production of uniform chromium oxide deposits having occluded lubricants therein over a wide range of substrates in the presence of a variety of bath and surface contaminants. Other objects of the invention will be apparent to those skilled in the art upon inspection of the following detailed disclosure.

In accordance with certain of its aspects, this invention relates to novel lubricating compositions and to a process for treating metal sheet or strip stock to impart lubricity and abrasion resistance thereto which comprises electrodepositing a lubricating film containing both trivalent chromium oxide and water soluble surfactant from an aqueous bath composition containing hexavalent chromium and at least one water soluble surfactant which comprises passing current from an anode to a cathode through said aqueous bath composition for a time period sufficient to deposit a lubricant-containing trivalent chromium oxide film upon said cathode.

It has unexpectedly been found that the codeposition of water soluble surfactants with chromium oxide results in said water soluble surfactant being occluded in the resulting protective film. The presence of those occluded, codeposited surfactants permits metal sheets treated therewith to slide against each other without abrasion or scratching. The presence of the surfactants of this invention is not deleterious to the adhesion of subsequent enameling as opposed to the excessive applications of oils which cause "eyeholing" in enamel.

The basis material which may be treated according to this invention to produce a trivalent chromium oxide film with occluded surfactant therein includes a basis material such as iron, steel, brass, bronze, copper, zinc, aluminum, magnesium, nickel, chromium, tin and lead either pure or in the form of an alloy or as multilayer deposits. The preferred basis metal to be treated in accordance with this invention may be steel, zinc, aluminum, or tin and most preferably, steel, such as can stock, which has first been plated with a conductive deposit such as zinc, tin, chromium, etc. to form a lubricating codeposit of water soluble surfactant and trivalent chromium oxide film.

Other basis materials which can be treated by the process of this invention include metal-clad plastics and resins including acrylonitrile-butadiene-styrene, acetals, acrylics, alkyds, alkyls, amines, cellulosics, chlorinated polyethers, epoxies, furanes, fluorocarbons, isocyanates (urethanes), polyamides (nylons), phenoxides, phenolics, polycarbonates, polyesters, polyethylenes, silicones, polystyrenes, polyvinyls, and copolymers, etc. of these materials. When the basis material to be treated by the process of this invention is a plastic or resin, the surface thereof will be treated by deposition thereon of a conductive deposit, such as a copper deposit or a thin laminate of steel, etc.

The basis material bearing a conductive surface, such as steel, may be immediately treated after deposition of such plate or it may be further treated or fabricated into the desired shape prior to formation of a trivalent chromium oxide film codeposited with a water soluble surfactant on the surface.

The water soluble surfactant of this invention comprises at least one member of the group consisting essentially of organic sulfonic acids exhibiting from 6 to 30 carbon atoms, the sodium and potassium salts of said sulfonic acids, and the mixed sodium and potassium salts and organic disulfonic and trisulfonic acids. Typical of the sulfonic acids are hexyl sulfonic acids, octyl sulfonic acids, nonyl sulfonic acids, decyl sulfonic acids, dodecyl sulfonic acids, pentadecyl sulfonic acids, octadecyl sulfonic acids, naphthyl butyl sulfonic acids, naphthyl octyl sulfonic acids, benzyl sulfonic acids, butylbenzyl sulfonic acids, chlorobenzyl sulfonic acids, dichlorobenzyl sulfonic acids, bromobenzyl sulfonic acids, fluorobenzyl sulfonic acids, perfluorobenzyl sulfonic acids, octylbenzyl sulfonic acids, dodecylbenzyl sulfonic acids, dimethylbenzyl sulfonic acids, methylbutylbenzyl sulfonic acids, dihexylbenzyl sulfonic acids, phenylethyl sulfonic acids, butylphenylethyl sulfonic acids, phenylbutyl sulfonic acids, phenyldodecyl sulfonic acids, and naphthylethyl sulfonic acids.

Illustrative surfactants of the sulfonate variety operable in the practice of this invention include: water soluble salts of the higher alkylated benzene sulfonic acids such as the sodium and potassium salts of dodecyl benzene and Keryl benzene sulfonic acids. Alkane sulfonic acids both straight and branched chain may also be employed.

Specific highly preferred lubricants include: sodium dodecyldiphenyletherdisulfonate, hexylbenzenesulfonate, octylsulfonate, and perfluoroethylcyclohexylsulfonic acid.

The organic surfactant should be present in the range of 0.05 grams per liter to 20.0 grams per liter, preferably from 0.5 grams per liter to 10.0 grams per liter.

The aqueous bath composition containing hexavalent chromium which is employed according to the invention may be prepared from diluted commercial chromic acid electroplating solutions. Preferably, a portion or all of the chromic acid used in the bath composition may be replaced by a salt of hexavalent chromium such as sodium chromate, sodium dichromate, potassium chromate, potassium dichromate, strontium chromate, magnesium dichromate, lanthanum chromate, lanthanum dichromate, etc. In many cases it may be advantageous to employ one or more of such salts in order to provide for a means of control of the concentrations of the ingredients of the compositions or to control the acidity of the aqueous hexavalent chromium containing bath.

Catalyst anions may also be included in the aqueous hexavalent chromium water soluble surfactant containing bath without producing any detrimental effects during the application of electric current to form the trivalent chromium oxide deposits. For example, sulfate, chloride, fluoride, and complex fluorides may be used. Typically, fluosilicates, fluoborates, fluoaluminates, fluotitanates, and fluozirconates may be included in the aqueous chromium bath composition without adversely affecting quality of the novel trivalent chromium oxide electrodeposit which is produced according to the invention.

Neutralizers and/or buffers may also be employed in the bath compositions of the invention. Examples of such neutralizers or buffers include phosphates, borates, and carboxylates. In addition, catalyst anions as heretofore recited may also be used in amounts sufficient to act as buffers or neutralizers in combined effect with their catalyst properties.

The hydrocarbyl sulfonic acids, halohydrocarbyl sulfonic acids, and salts therefor which may be used according to the invention may contain at least 6 carbon atoms, and, typically, from 6 to 30 carbon atoms. Most preferred hydrocarbyl sulfonic acids are alkyl sulfonic acids (including salts thereof) which contain alkyl or alkaryl groups of 6–18 carbon atoms. Typical halogen substituents of the halohydrocarbyl group are chlorine, bromine, and fluorine.

The benefits of the practice of this invention can be seen from a comparison of the pull required to reduce the diameter of a chromium plated steel wire electrolytically treated in a solution containing a water soluble surfactant of this invention and a chromium plated wire not thus treated.

Examples of suitable bath compositions and concentrations are set forth in Table I.

TABLE I

| | All amounts in Grams Per Liter (g/l) | | |
|---|---|---|---|
| | Typical | Preferred | Optimum |
| Hydrocarbyl sulfonic acid or halohydrocarbyl sulfonic acid | 0.05–20 | 0.5–10 | 0.5–10 |
| Chromic acid | 1–100 | 20–70 | 30–50 |
| Temperature (° C) | 40–85 | 50–70 | 50–70 |
| Current Density (Amperes per Square Decimeter, asd) | 1–30 | 4–22 | 8–16 |
| Charge Density (Coulombs/sq. Decimeter, CSD) | .5–150 | 2–110 | 4–80 |

A typical bath composition which may be used in the invention to produce a trivalent chromium oxide lubricating film may comprise chromic acid in the amount of 1–100 grams per liter as $CrO_3$ (including salts thereof) in combination with 0.05–20 grams per liter of a water soluble surfactant (including salts thereof) of formula (I). Other bath compatible materials may be incorporated in the bath. For example, inorganic sulfates and fluorides or complex fluorides and phosphates may be incorporated into the bath.

A specific bath composition may contain the following ingredients in the amounts indicated:

| | All Amounts in Grams Per Liter (g/l) |
|---|---|
| Chromic acid ($CrO_3$) | 5–100 |
| Sulfate ($SO_4^{=}$) | 0.1–2.5 |
| Hydrocarbylsulfonic acid | 0.5–10 |
| Silicofluoride ($SiF_6^{=}$) | 0.3–1.5 |
| Current density (asd) | 1–30 |
| Coulombs/sq. Decimeter (CSD) | 1–38 |

The water soluble lubricant trivalent chromium oxide film deposit may be obtained using current of 1–30 amperes per square decimeter (asd) at temperatures of 40°–85° C, for time periods of one-half second to 5 seconds (typically 1–2 seconds).

The trivalent chromium oxide film cathodic deposits prepared using the compositions of the invention may contain 0.1–100 milligrams of occluded surfactant and from 3–300 milligrams of trivalent chromium oxide per square meter of treated surface. The surfaces of such lubricating trivalent chromium oxide films may subsequently be given a supplementary light oil treatment if desired. Similarly, organic or inorganic coatings may be used to provide a vapor barrier or to otherwise protect all or a portion of said surfaces.

The following examples are submitted for the purpose of illustration only and are not to be construed as limiting the scope of the invention in any way.

EXAMPLE 1

An aqueous bath composition containing a water soluble surfactant and hexavalent chromium was prepared by combining the following ingredients in water with the indicated amounts (all concentrations being in grams per liter of total solution, unless otherwise specified herein):

| Component | Grams per liter |
|---|---|
| Chromic acid ($CrO_3$) | 50 |
| Sulfate ($SO_4^{=}$) | 0.25 |
| Sodium dodecyldiphenylether disulfonate | 1.0 |
| Silicofluoride ($SiF_6^{=}$) | 0.6 |

A 0.16 centimeter outside diameter soft annealed steel wire was pulled through a wire strip line at 600 centimeters per minute. The wire was cleaned, pickled, chromium plated, and chemically treated cathodically, and using a current of 16.0 amperes per square decimeter was passed through the solution for a period of 1.00 seconds while maintaining the bath solution at about 51° C. The chromium in oxide was 31 milligrams per square meter and 11.8 milligrams per square meter of occluded wetting agent. The standard pull test gave a value of 34.4 kilograms.

The following examples were carried out using the same conditions and bath composition as Example 1, except that hydrocarbyl sulfonic acid, halohydrocarbyl sulfonic acid, or salt thereof was varied:

EXAMPLE 2

The same chromium treating solution was used as in Example 1 except that the current density was lowered to 8.0 amperes per square decimeter which reduced the chromium in oxide value to 16.2 milligrams per square meter. The wetting agent level was again at 1.065 milligrams per square meter and the pull required for the wire reduction remained at 34.4 kilograms.

EXAMPLE 3

The same solution was used as in Example 1 except that 8 milliliters per liter of 70% methyl sulfonic acid was added. The current density used was 17.2 amperes per square decimeter. This yielded chromium in oxide value of 140 milligrams per square meter and 0.67 milligrams per square meter of wetting agent. The pull required was 35.5 kilograms.

EXAMPLE 4

The same solution was used as in Example 3 except that the current density was reduced to 7.86 amperes per square decimeter. This yielded 28 milligrams per square meter of chromium in oxide and 0.68 milligrams per square meter of wetting agent and required 36.2 kilograms.

EXAMPLE 5

A chromium plated steel wire plated to a thickness of 0.07 microns with an initial diameter of 0.158 centimeter was cathodically treated in the following solution to give an oxide film plus an occluded amount of organic wetting agent:

50 gm/liter $CrO_3$
0.25 gm/liter $SO_4^=$
0.6 gm/liter $SIF_6^=$
1 gm/liter Hexylbenzenesulfonate
1.25 seconds
3.9 amperes per square decimeter (asd)

The pull required to draw this wire through the die was 32.2 kilograms.

EXAMPLE 6

Chromium plated steel wire, plated to a thickness of 0.07 microns of chromium with an initial diameter of 0.158 centimeter required 39.0 kilograms of pull to draw it through a 0.154 centimeter diameter die at 5.1 centimeters per minute.

EXAMPLE 7

Steel panels, chromium plated to approximately 0.07 microns were cathodically treated in the following solution:

50 gm/liter $CrO_3$
0.25 gm/liter $SO_4^=$
0.6 gm/liter $SIF_6^=$
0.5 gm/liter perfluoroethylcyclohexyl sulfonic acid
23 amperes per square decimeter (asd)
1.11 seconds
52° C This panel yielded 9.25 milligrams per square meter of chromium in oxide and 21.5 milligrams per square meter of wetting agent.

EXAMPLE 8

Steel panels chromium plated to approximately 0.07 microns were cathodically treated in the following solution:

50 gm/liter $CrO_3$
8 ml/liter 70% Methyl sulfonic acid
0.5 gm/liter Perfluoroethylcyclohexyl sulfonic acid
7.4 amperes per square decimeter (asd)
0.25 seconds 9.7 milligrams per square meter of chromium in oxide and 17 milligrams per square meter of wetting agent was found in the resulting film.

EXAMPLE 9

Steel panels chromium plated to approximately 0.07 microns were cathodically treated in the following solution:

50 gm/liter $CrO_3$
10 gm/liter Sodiumdodecyldiphenylether disulfonate
37.6 amperes per square decimeter (asd)
3 seconds
52° C This panel yielded 20.5 milligrams per square meter of wetting agent occluded with 163 milligrams per square meter of chromium in oxide.

EXAMPLE 10

The same solution and panels as in Example 9 were used except that the current density was reduced to 0.56 amperes per square decimeter and the time reduced to two seconds. This yielded 9.7 milligrams per square meter of occluded wetting agent and a chromium in oxide level of 4.3 milligrams per square meter.

The panels prepared in Examples 7, 8, 9, and 10 coated with commercial "C" and "V" enamels as used in can stock and exposed to a synthetic sulfide stain test exhibited a rating of 0 (perfect) when subsequently tested with the standard Scotch Tape Test for enamel adhesion.

Although this invention has been illustrated by reference to specific embodiments, modifications thereof which are clearly within the scope of the invention will be apparent to those skilled in the art.

I claim:

1. A process for treating metal sheet and strip stock to impart lubricity and abrasion resistance thereto which comprises electrodepositing a lubricating film containing both trivalent chromium oxide and a water soluble surfactant from an aqueous bath composition and containing hexavalent chromic acid in a concentration of from 1 gram per liter to 100 grams per liter and at least one water soluble surfactant in a concentration of 0.05 grams per liter to 20 grams per liter which comprises passing current from an anode to a cathode through said aqueous bath composition, at a current of 1–30 amperes per square decimeter (asd) and a temperature of 40°–85° C, for a time period of from 0.5 to 5 seconds to deposit a lubricant containing trivalent chromium oxide film containing 0.1 milligrams to 100 milligrams of occluded surfactant and 3 milligrams to 300 milligrams of trivalent chromium oxide per square meter of treated surface upon said cathode.

2. A process as claimed in claim 1 wherein the water soluble surfactant comprises at least one member selected from the group consisting essentially of organic sulfonic acids having from 6 to 30 carbon atoms, the sodium and potassium salts of mono sulfonic acids, and the mixed sodium and potassium salts of organic disulfonic and trisulfonic acids.

3. A process as claimed in claim 2 wherein the water soluble surfactant is sodium dodecyldiphenylether disulfonate.

4. A process as claimed in claim 2 wherein the water soluble surfactant is hexylbenzene sulfonate.

5. A process as claimed in claim 2 wherein water soluble surfactant is perfluoroethylcyclohexyl sulfonic acid.

6. A process as claimed in claim 1 wherein the amount of water soluble surfactant is 0.1–100 mg/m² in the deposit of lubricant-containing trivalent chromium oxide film.

7. A process as claimed in claim 1 wherein the deposit of trivalent chromium oxide film is essentially free of hexavalent chromium.

* * * * *